US007137931B2

(12) United States Patent
Liu

(10) Patent No.: US 7,137,931 B2
(45) Date of Patent: Nov. 21, 2006

(54) WEIGHT LIFTING DEVICE HAVING SELECTOR DEVICE

(76) Inventor: Wei Ming Liu, P.O. Box 63-99, Taichung (TW) 406

( * ) Notice: Subject to any disclaimer, the term of this patent is extended or adjusted under 35 U.S.C. 154(b) by 231 days.

(21) Appl. No.: 10/867,550

(22) Filed: Jun. 10, 2004

(65) Prior Publication Data

US 2005/0277525 A1 Dec. 15, 2005

(51) Int. Cl.
*A63B 21/072* (2006.01)

(52) U.S. Cl. ..... 482/107; 482/106; 482/108

(58) Field of Classification Search ..... 482/106–109
See application file for complete search history.

(56) References Cited

U.S. PATENT DOCUMENTS 4,982,957 A * 1/1991 Shields ..... 482/104
5,123,885 A * 6/1992 Shields ..... 482/106
5,407,413 A * 4/1995 Kupferman ..... 482/106
5,839,997 A * 11/1998 Roth et al. ..... 482/107
6,416,446 B1 * 7/2002 Krull ..... 482/108
6,656,093 B1 12/2003 Chen ..... 482/108
6,679,816 B1 * 1/2004 Krull ..... 482/107
6,749,547 B1 * 6/2004 Krull ..... 482/106
2002/0022559 A * 2/2000 Krull ..... 482/106
2002/0055426 A1 5/2002 Krull
2004/0005968 A1 * 1/2004 Crawford et al. ..... 482/106

* cited by examiner

*Primary Examiner*—Stephen R. Crow
*Assistant Examiner*—Allana Lewin
(74) *Attorney, Agent, or Firm*—Charles E. Baxley

(57) ABSTRACT

A weight lifting device includes a handle having two end segments, a number of weight members each having a slot to receive either of the end segments of the handle, and an anchor plate rotatably attached to each of the weight members and having an opening selectively aligned with the slot of the weight member, to selectively receive either of the end segments of the handle. The anchor plate is rotatable relative to the weight member to offset the opening of the anchor plate from the slot of the weight member, and to selectively anchor the weight member to the handle. The desired number of weight members may thus be selectively attached to the handle.

9 Claims, 7 Drawing Sheets

WEIGHT LIFTING DEVICE HAVING SELECTOR DEVICE

BACKGROUND OF THE INVENTION

1. Field of the Invention

The present invention relates to a weight lifting device, and more particularly to a weight lifting device having a selector device to randomly or selectively secure or anchor various numbers of weight members to the handle.

2. Description of the Prior Art

Various kinds of typical weight lifting devices or dumbbells have been developed and comprise a number of weight members to be adjustably secured or attached onto a handle, to allow the users to lift their own desired weights.

For example, U.S. Pat. No. 5,839,997 to Roth et al. discloses one of the typical weight lifting devices or dumbbells comprising a rotatable shaft to select a desired number of weight members to the handle, without interrupting their exercise routine.

However, the closer or the inner weight members should first be selected and secured or attached onto the handle before the distal or the outer weight members are selectively secured or attached onto the handle, such that the weight members may not be randomly secured or attached onto the handle.

U.S. Pat. No. 6,656,093 to Chen discloses another typical weight lifting device or dumbbell comprising a slidable latch to select a desired number of weight members to the handle. However, similarly, the closer or the inner weight members should first be selected and secured or attached onto the handle before the distal or the outer weight members are selectively secured or attached onto the handle, such that the weight members also may not be randomly secured or attached onto the handle.

U.S. Patent Publication No. 2002/0055426 A1 discloses a further typical weight lifting device or exercise resistance device comprising selector rods selectively moved into engagement with the desired number of weight members on each side of the base member. However, similarly, the closer or the inner weight members should first be selected and secured or attached onto the handle before the distal or the outer weight members are selectively secured or attached onto the handle, such that the weight members also may not be randomly secured or attached onto the handle.

The present invention has arisen to mitigate and/or obviate the afore-described disadvantages of the conventional weight lifting devices.

SUMMARY OF THE INVENTION

The primary objective of the present invention is to provide a weight lifting device including a selector device to randomly or selectively secure or anchor various numbers of weight members to the handle.

In accordance with one aspect of the invention, there is provided a weight lifting device comprising a handle including two end segments, a weight member including a slot formed therein, for receiving either of the end segments of the handle, and an anchor plate rotatably attached to the weight member, and including an opening formed therein and selectively aligned with the slot of the weight member, to selectively receive either of the end segments of the handle. The anchor plate is rotatable relative to the weight member to offset the opening of the anchor plate from the slot of the weight member, and to selectively anchor the weight member to the handle.

The weight member includes at least one peg attached thereto, the anchor plate includes at least one curved channel formed therein, to slidably receive the peg of the weight member, and to rotatably attach the anchor plate to the weight member. The peg of the weight member includes an enlarged head provided thereon, to engage with the anchor plate, and to retain the anchor plate to the weight member, and to prevent the anchor plate from being disengaged from the weight member.

The weight member includes a spring biased projection received therein, and engageable with the anchor plate, to maintain the opening of the anchor plate in alignment with the slot of the weight member. The anchor plate includes a cavity formed therein, to selectively receive the spring biased projection of the weight member.

The weight member may further include another spring biased projection received therein, and engageable with the anchor plate, to maintain the opening of the anchor plate in offset from the slot of the weight member.

Either of the end segments of the handle includes at least one notch formed therein, and defined between protuberances, to receive the anchor plate and the weight member. The anchor plate includes a hand grip extended therefrom, for rotating the anchor plate relative to the weight member.

A base may further be provided and includes a plurality of depressions formed therein for receiving the weight member. The weight member includes an indentation formed therein, and the base includes a projection extended into each of the depressions thereof, and engageable into the indentation of the weight member, to anchor the weight member to the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
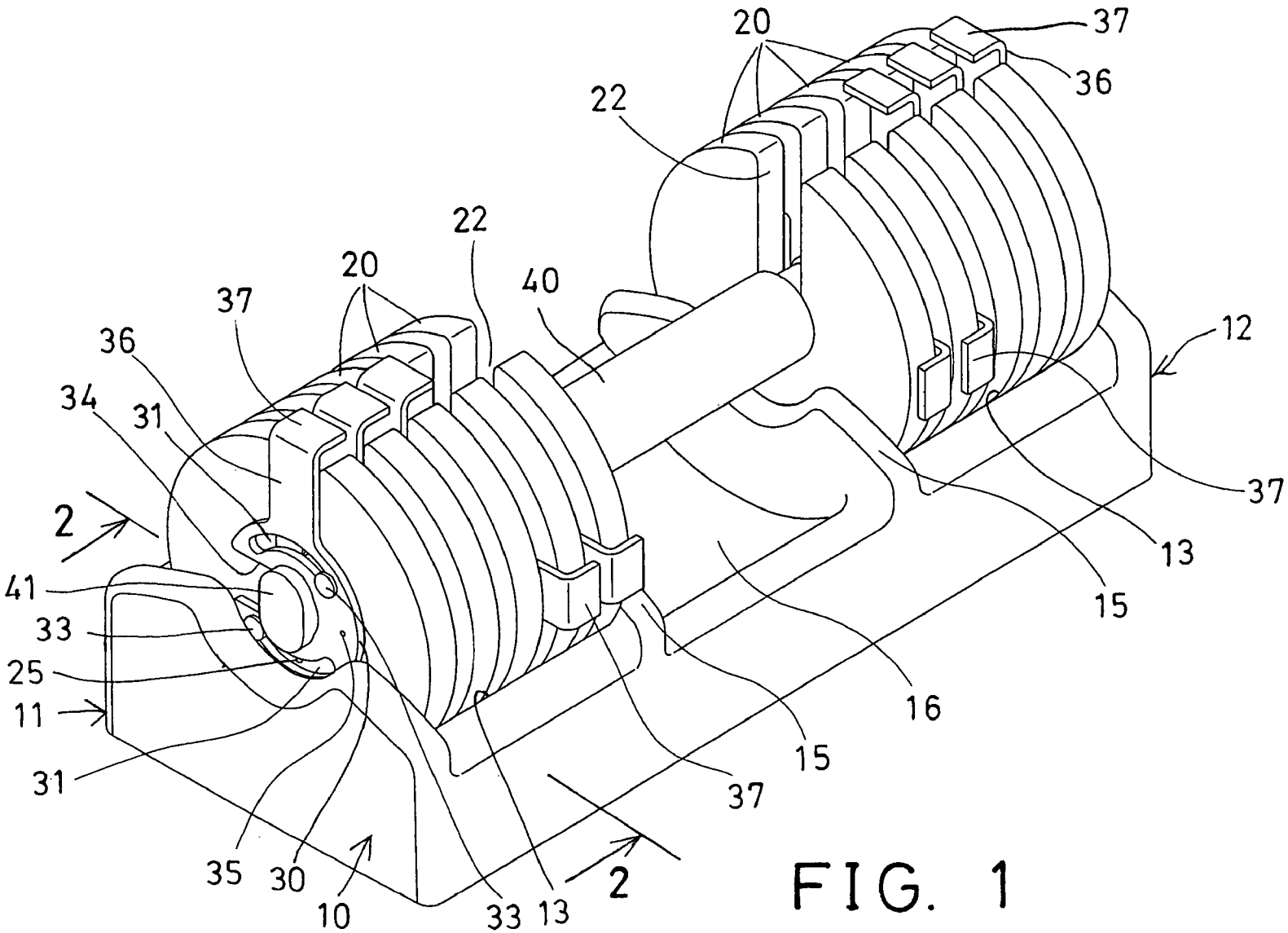
FIG. 1 is a perspective view of a weight lifting device having a selector device in accordance with the present invention.
Figure 2:
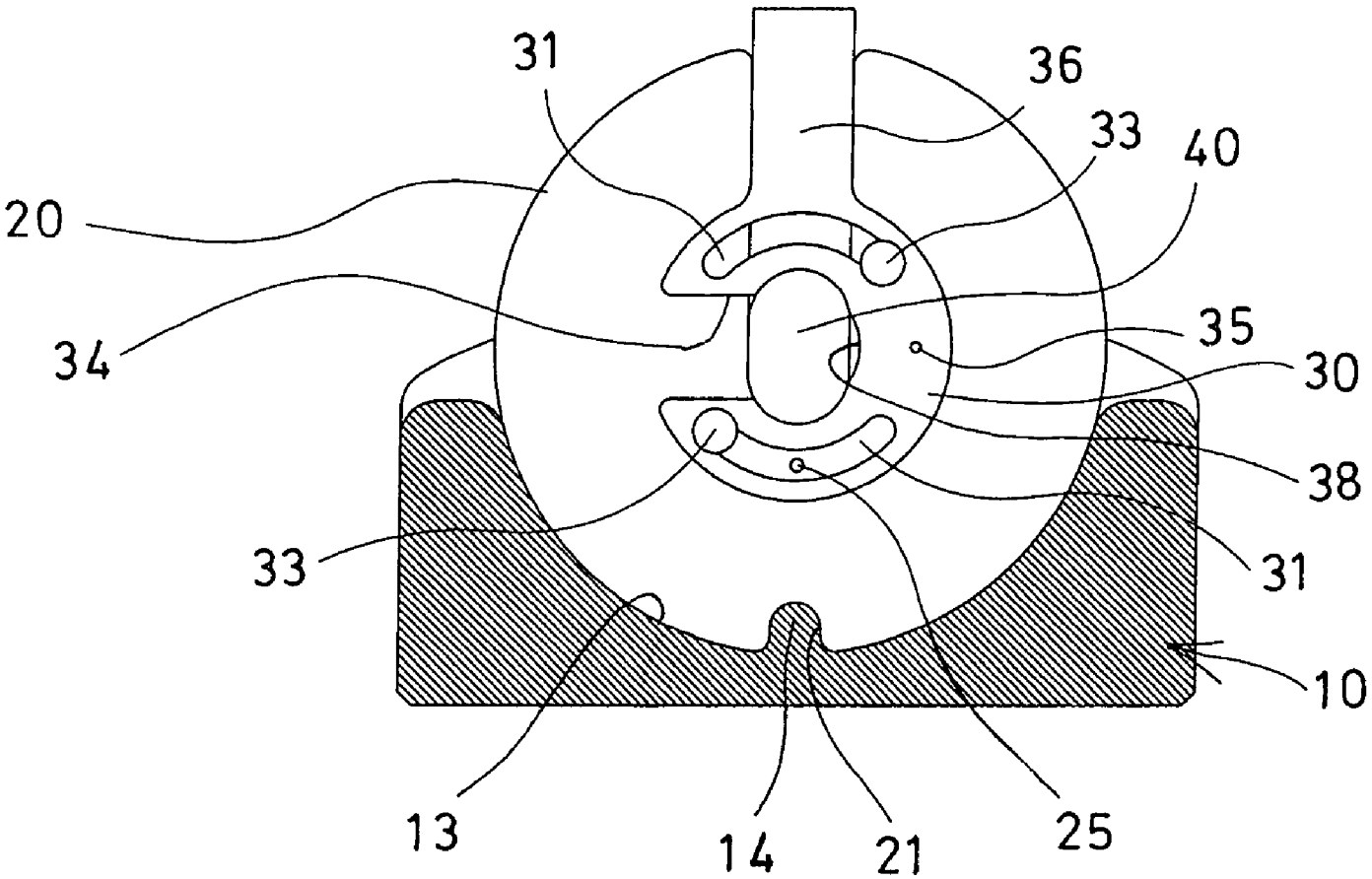
FIG. 2 is a partial cross sectional view taken along lines 2—2 of FIG. 1.
Figure 3:
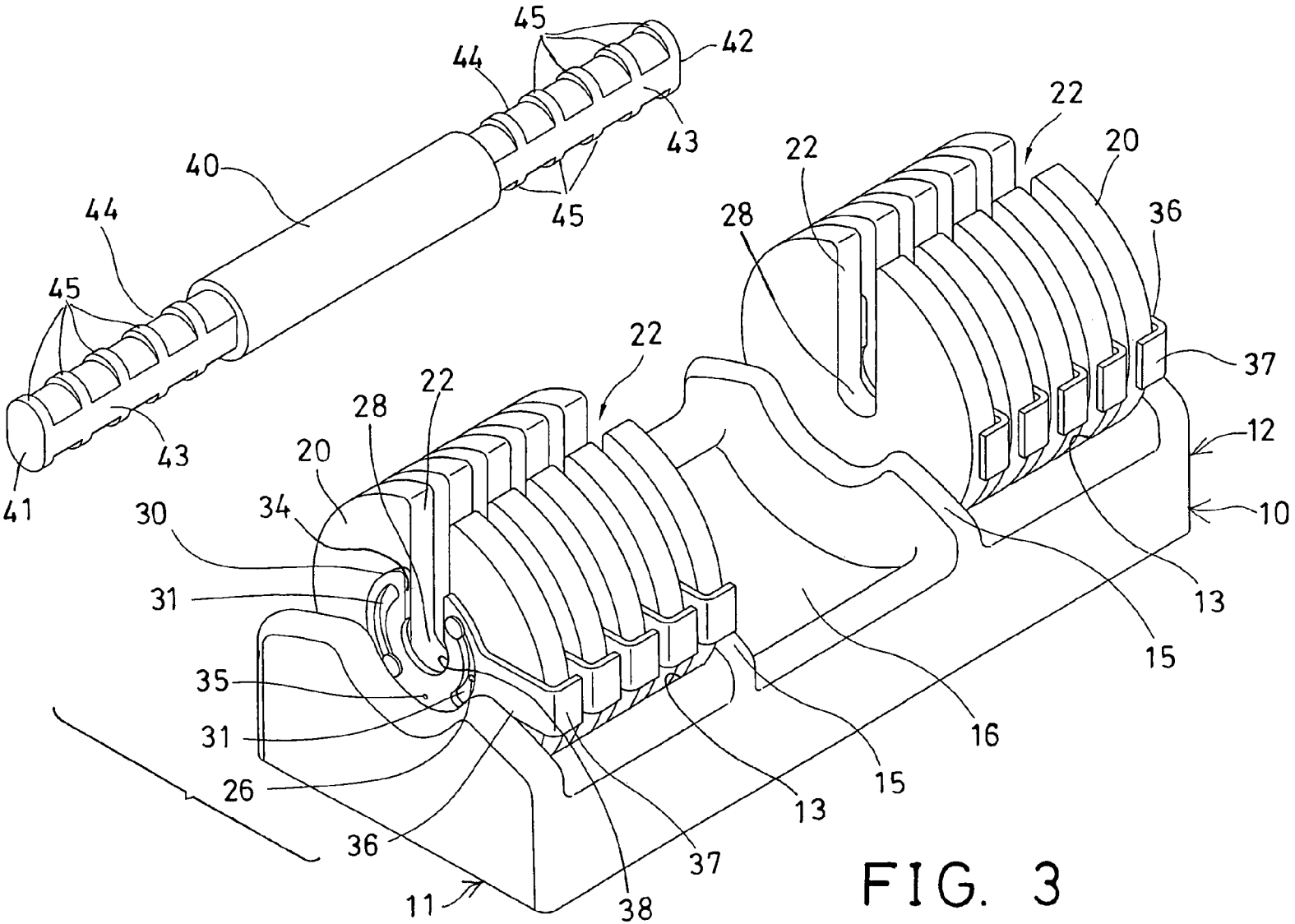
FIG. 3 is a partial exploded view of the weight lifting device having a handle separated therefrom.

Referring to the drawings, and initially to FIGS. 1–3, a weight lifting device in accordance with the present invention comprises a base 10 including two side portions 11, 12 each having a number of curved depressions 13 formed therein (FIG. 2) for receiving weight members 20 respectively, and a number of projections 14 extended into the respective depressions 13 thereof (FIG. 2). The base 10 includes two partitions 15 extended or provided in the middle portion thereof, to form or define a recess 16 between the partitions 15.

Figure 4:
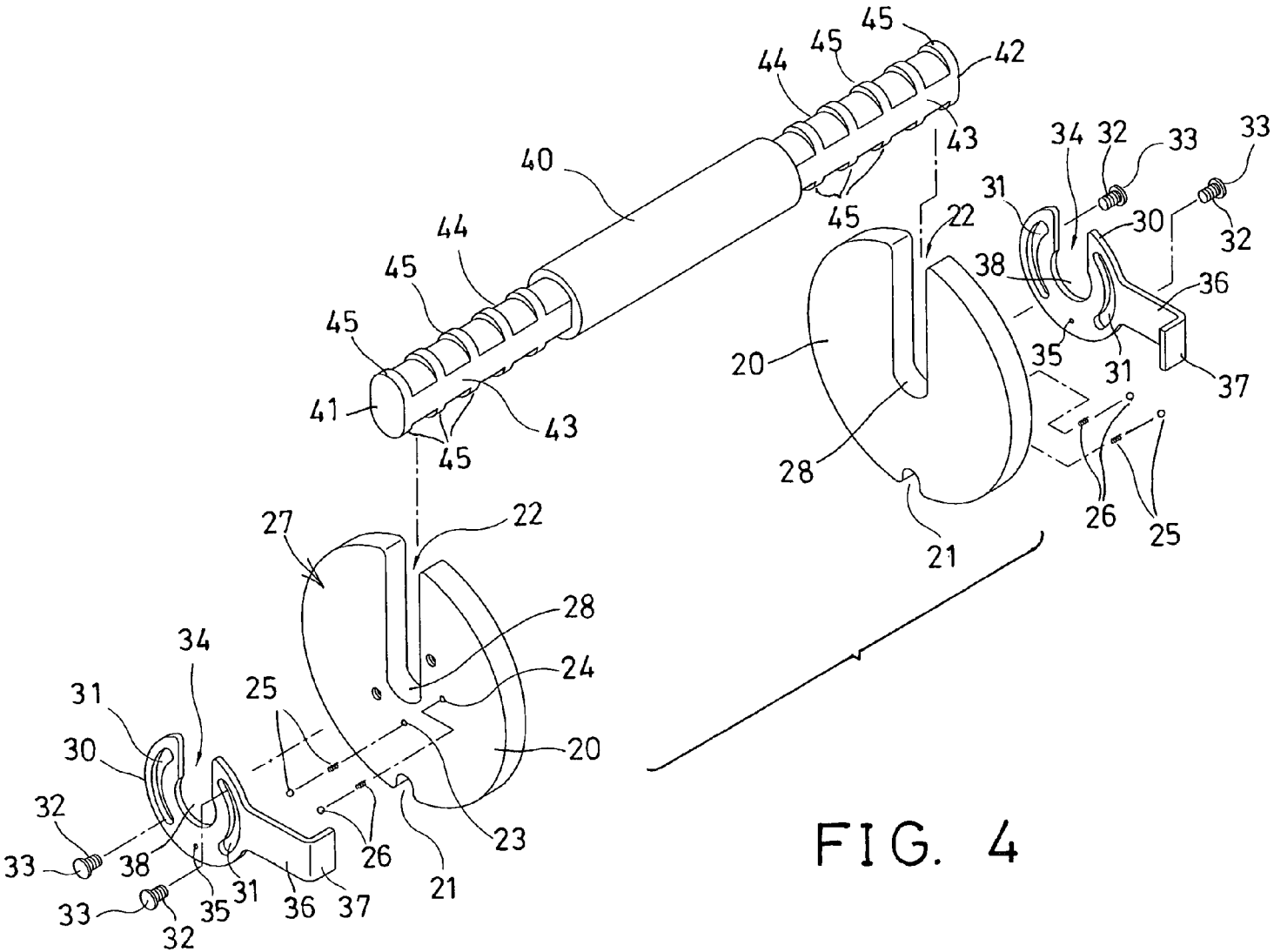
FIG. 4 is another partial exploded view of the weight lifting device.

Each of the weight members 20 includes an indentation 21 formed in the bottom thereof, to receive the corresponding projections 14 of the base 10, and thus to position the base 10 within the depressions 13 of the base 10. Each of the weight members 20 further includes a slot 22 formed in top thereof, extended from a center hole 28 (FIGS. 3, 4) to a perimeter of the associate weight members 20. The engagement of the projections 14 of the base 10 in the indentations 21 of the weight members 20 may be used to align the slots 22 of the weight members 20 with each other (FIG. 3).

Each of the weight members 20 further includes one or more, such as two cavities 23, 24 formed in one side surface 27 thereof (FIG. 4), and spring biased projections 25, 26 received in the cavities 23, 24 of the weight members 20 respectively. The spring biased projections 25, 26 may only be slightly or partially extended out of the cavities 23, 24 of the weight members 20 respectively, but may not be completely extended out of the cavities 23, 24 of the weight members 20.

Each of the weight members 20 further includes a selector or anchor plate 30 rotatably attached thereto. For example, each of the selector or anchor plates 30 includes one or more, such as two curved channels 31 formed therein, and one or more, such as two fasteners or pegs 32 secured or threaded to the associate weight members 20, and slidably engaged in the curved channels 31 of the anchor plate 30, to rotatably attached the anchor plate 30 to the associate weight members 20. Each of the pegs 32 includes an enlarged head 33 provided thereon, to engage with the anchor plate 30, and to retain the anchor plate 30 to the associate weight members 20, and to prevent the anchor plate 30 from being disengaged from the associate weight members 20.

Figure 5:
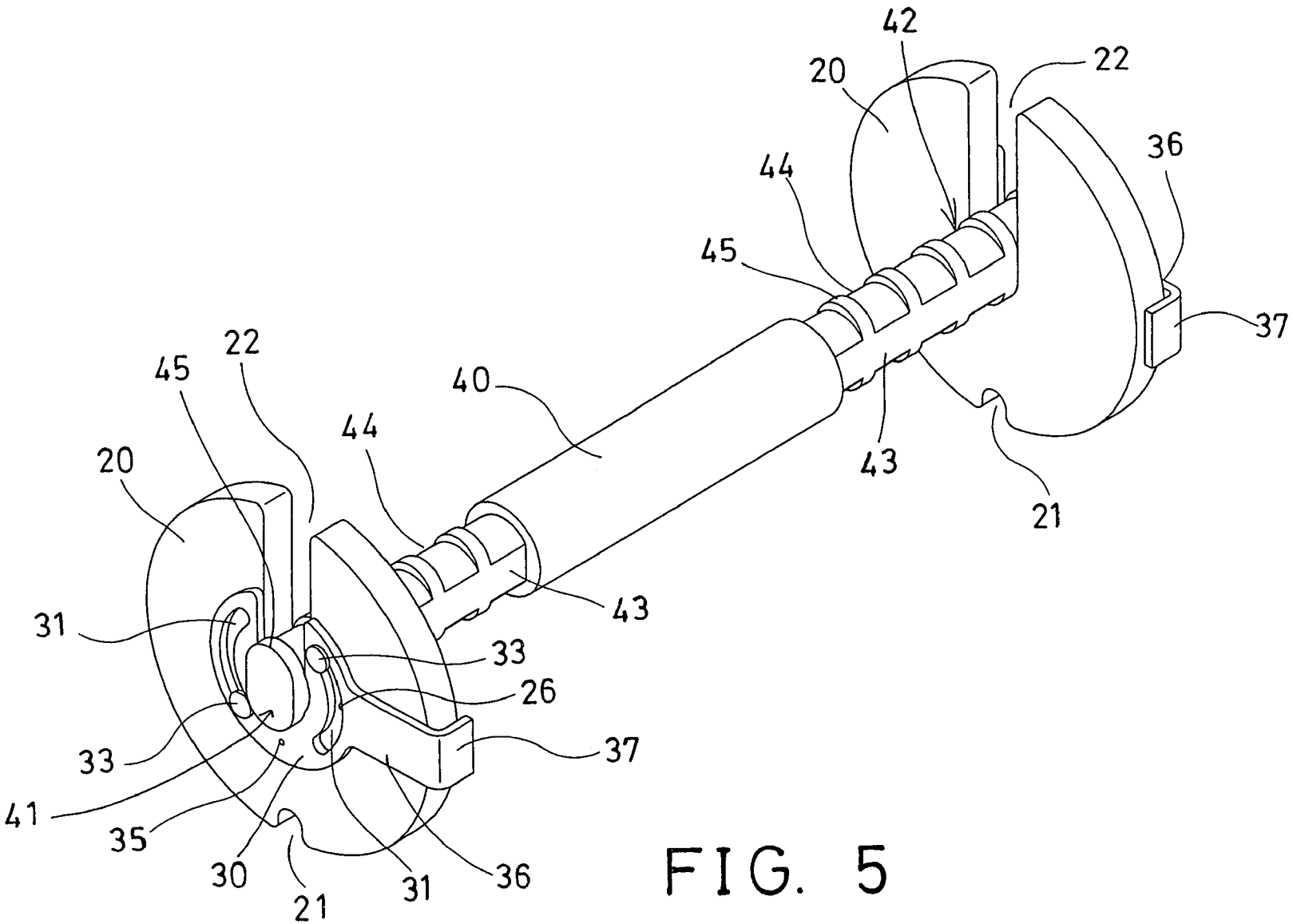
FIG. 5 is a perspective view illustrating an attachment of the handle to the weight members.

Each of the anchor plates 30 includes an opening 34 formed therein and extended from a center hole 38 (FIGS. 3, 4) to a perimeter of the associate anchor plates 30, and selectively aligned with the center hole 28 and the slot 22 of the associate weight members 20 (FIGS. 3, 5). The anchor plates 30 may be rotated relative to the associate weight members 20, to selectively block or shield the slot 22 of the associate weight members 20 (FIGS. 1–2, and 6–7), but to allow only the center holes 28, 38 of weight members 20 and of the anchor plates 30 to be aligned with each other.

Each of the anchor plates 30 includes a cavity 35 formed therein, to receive either of the spring biased projections 25, 26, and thus to position or to anchor the anchor plates 30 to the associate weight members 20 respectively. For example, when the spring biased projection 25 is engaged into the cavity 35 of the anchor plate 30, the opening 34 of the anchor plate 30 may be maintained in alignment with the slot 22 of the associate weight member 20 (FIGS. 3, 5). On the contrary, when the other spring biased projection 26 is engaged into the cavity 35 of the anchor plate 30, the anchor plate 30 may be retained to the associate weight member 20 at a position where the opening 34 of the anchor plate 30 is offset from the slot 22 of the associate weight member 20 (FIGS. 1, 6, 7).

Figure 6:
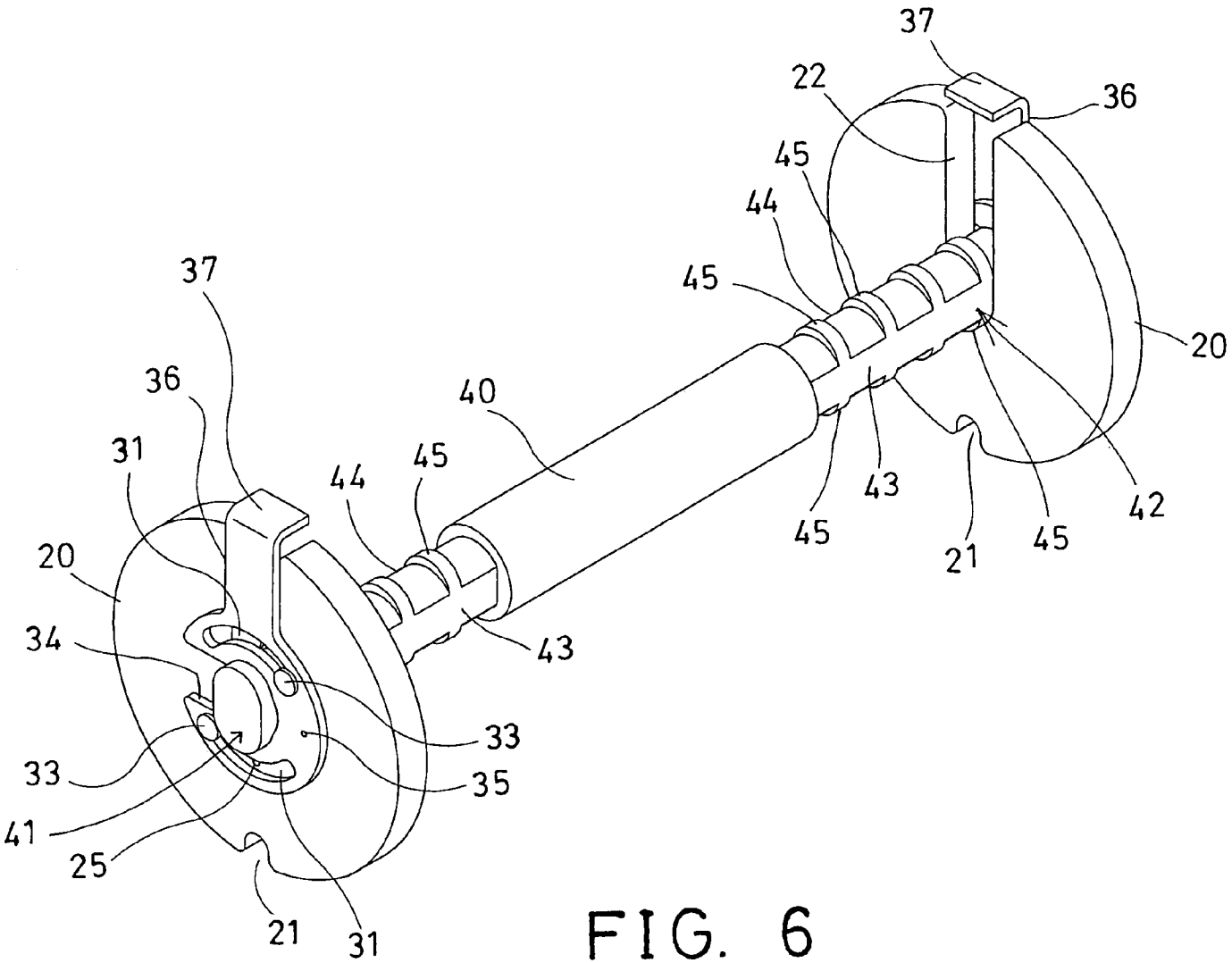
FIG. 6 is a perspective view similar to FIG. 5, illustrating the operation of the weight lifting device.
Figure 7:
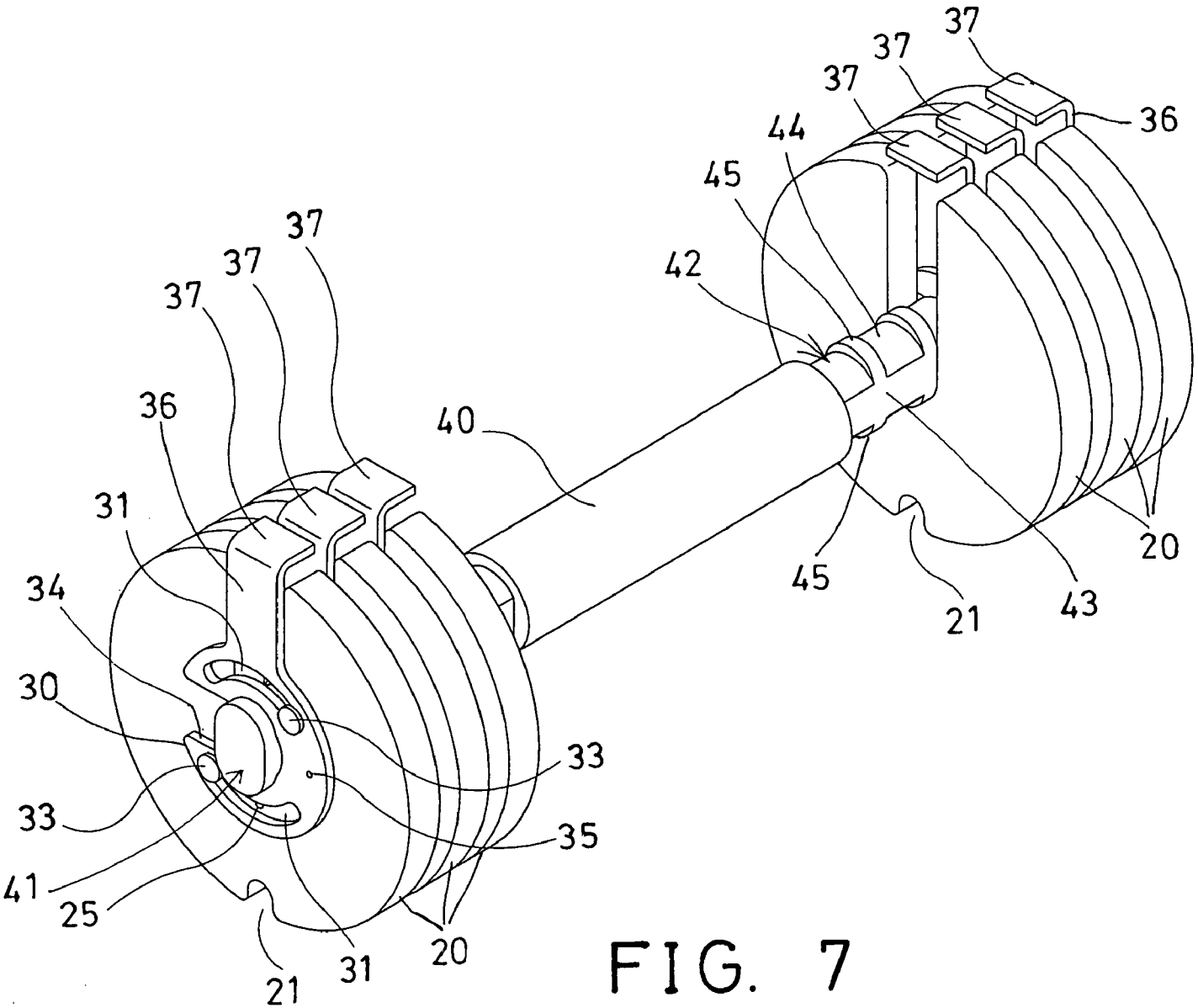
FIG. 7 is a further perspective view similar to FIGS. 5, 6, illustrating the attachment of the handle to various numbers of the weight members.

Each of the anchor plates 30 further includes an extension 36 extended therefrom, and a hand grip 37 bent or laterally extended from the extension 36, for blocking or shielding the slot 22 of the associate weight member 20 (FIGS. 1, 6, 7) when the opening 34 of the anchor plate 30 is offset from the slot 22 of the associate weight member 20 (FIGS. 1, 6, 7).

A handle 40 includes two end segments 41, 42 for engaging into the slots 22 of the weight members 20, and into the openings 34 of the anchor plates 30, and each of the end segments 41, 42 includes one or more, such as two opposite flat surfaces 43 formed therein, for forming a non-circular cross section to the end segments 41, 42, and for preventing the end segments 41, 42 of the handle 40 from being rotated relative to the weight members 20 and the anchor plates 30.

Each of the end segments 41, 42 of the handle 40 includes a number of notches 44 formed therein, and defined between protuberances 45 of the handle 40 for receiving the anchor plates 30. It is preferable that the width of each of the notches 44 of the end segments 41, 42 of the handle 40 is equal to the thickness of both the weight member 20 and the anchor plate 30, to allow the combination of the weight member 20 and the anchor plate 30 to be stably attached or retained to the handle 40 by anchoring or positioning the weight member 20 and the anchor plate 30 between the protuberances 45 (FIG. 6).

In operation, as shown in FIG. 3, when the openings 34 of the anchor plates 30 are aligned with the slots 22 of the weight members 20, the end segments 41, 42 of the handle 40 may be easily engaged into the slots 22 of the weight members 20, and into the openings 34 of the anchor plates 30. As shown in FIG. 1, when the selected anchor plates 30 is rotated relative to the associate weight members 20 with the hand grips 37, the opening 34 of the anchor plate 30 may be offset from the slot 22 of the associate weight member 20, and the anchor plate 30 may be engaged with the protuberances 45 of the handle 40, to anchor the selected weight members 20 to the handle 40, and thus to allow either of the selected weight members 20 to be selectively attached to the handle 40.

It is to be noted that the weight members 20 are not required to be attached onto the handle 40 in series, and may be randomly or selectively secured or anchored to the handle 40. For example, the first and the third and/or the fifth weight members 20 may be randomly or selectively secured or anchored to the handle 40 without attaching the second and/or the fourth weight member 20 to the handle 40.

None of the typical weight lifting devices or dumbbells provide an anchor plate 30 that may be rotatably attached to the associate weight member 20, and to offset the opening 34 of the anchor plate 30 from the slot 22 of the associate weight member 20, to randomly or selectively attach or secure the weight member 20 to the handle 40.

Accordingly, the weight lifting device in accordance with the present invention includes a selector device to randomly or selectively secure or anchor various numbers of weight members to the handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A weight lifting device comprising:

a handle including two end segments, a weight member including a center hold formed therein, and including a slot formed therein and extended from said center hole thereof to a perimeter of said weight member, for receiving either of said end segments of said handle, and an anchor plate rotatably attached to said weight member, and including a center hole formed therein, and including an opening formed therein, said opening extended from said center hole thereof to a perimeter of said anchor plate such that said center hole and said opening of said anchor plate form a continuous and uninterrupted aperture, and selectively aligned with said slot of said weight member to selectively receive either of said end segments of said handle, and said anchor plate being rotatable relative to said weight member to offset said opening of said anchor plate from said slot of said weight member, and to selectively anchor said weight member to said handle, and wherein said weight member includes at least one peg attached thereto, said anchor plate includes at least one enclosed curved channel formed therein to slidably receive said at least one peg of said weight member and to rotatably attach said anchor plate to said weight member.

2. The weight lifting device as claimed in claim 1, wherein said at least one peg of said weight member includes an enlarged head provided thereon, to engage with said anchor plate, and to retain said anchor plate to said weight member, and to prevent said anchor plate from being disengaged from said weight member.

3. The weight lifting device as claimed in claim 1, wherein said weight member includes a spring biased projection received therein, and engageable with said anchor plate, to maintain said opening of said anchor plate in alignment with said slot of said weight member.

4. The weight lifting device as claimed in claim 3, wherein said anchor plate includes a cavity formed therein, to selectively receive said spring biased projection of said weight member.

5. The weight lifting device as claimed in claim 1, wherein said weight member includes a spring biased projection received therein, and engageable with said anchor plate, to maintain said opening of said anchor plate in offset from said slot of said weight member.

6. The weight lifting device as claimed in claim 1, wherein either of said end segments of said handle includes at least one notch formed therein, and defined between protuberances, to receive said anchor plate and said weight member.

7. The weight lifting device as claimed in claim 1, wherein said anchor plate includes a hand grip extended therefrom, for rotating said anchor plate relative to said weight member.

8. The weight lifting device as claimed in claim 1 further comprising a base having a plurality of depressions formed therein for receiving said weight member.

9. The weight lifting device as claimed in claim 8, wherein said weight member includes an indentation formed therein, and said base includes a projection extended into each of said depressions thereof, and engageable into said indentation of said weight member, to anchor said weight member to said base.

* * * * *